US007103539B2

(12) United States Patent
Kleijn

(10) Patent No.: US 7,103,539 B2
(45) Date of Patent: Sep. 5, 2006

(54) ENHANCED CODED SPEECH

(75) Inventor: W. Bastiaan Kleijn, Stocksund (SE)

(73) Assignees: Global IP Sound Europe AB, Stockholm (SE); Global IP Sound Inc., San Francisco, CA (US)

( * ) Notice: Subject to any disclaimer, the term of this patent is extended or adjusted under 35 U.S.C. 154(b) by 643 days.

(21) Appl. No.: 10/036,747

(22) Filed: Nov. 8, 2001

(65) Prior Publication Data

US 2003/0097256 A1 May 22, 2003

(51) Int. Cl.
*G10L 21/02* (2006.01)

(52) U.S. Cl. ..... 704/226; 704/203; 704/207

(58) Field of Classification Search ..... 704/203, 704/207, 219, 224, 225, 226, 227, 228, 230
See application file for complete search history.

(56) References Cited

U.S. PATENT DOCUMENTS 5,241,650 A 8/1993 Gerson et al.
5,267,317 A 11/1993 Kleijn
5,544,278 A * 8/1996 Bialik et al. ..... 704/268
5,774,835 A * 6/1998 Ozawa ..... 704/205
5,899,967 A 5/1999 Nagasaki
5,937,379 A * 8/1999 Takagi ..... 704/233
6,477,489 B1 * 11/2002 Lockwood et al. ..... 704/200.1
6,549,586 B1 * 4/2003 Gustafsson et al. ..... 375/285
6,757,395 B1 * 6/2004 Fang et al. ..... 381/94.3
6,775,650 B1 * 8/2004 Lockwood et al. ..... 704/205

OTHER PUBLICATIONS

"Impulse Response," definition from Wikipedia, One page.*
Whitmal et al, "Reducing Correlated Noise in Digital Hearing Aids," IEEE Engineering in Medicine and Biology Magazine, Sep.-Oct. 1996, vol. 15, Issue 5, pp. 88 to 96.*
Ferrara Jr., et al., "Multichannel Adaptive Filtering for Signal Enhancement," IEEE Transactions on Acoustics, Speech, and Signal Processing, Jun. 1981, vol. 29, Issue 3, pp. 766 to 770.*
Yariv Ephraim, et al., *A Signal Subspace Approach for Speech Enhancement*, IEEE Transactions on Speech and Audio Processing, (Jul. 1995), vol. 3, No. 4, pp. 251-266.

(Continued)

*Primary Examiner*—Martin Lerner
(74) *Attorney, Agent, or Firm*—Birch, Stewart, Kolasch, and Birch, LLP

(57) ABSTRACT

According to the invention, a method for increasing quality of an enhanced output signal to approximate an undistorted sound signal is disclosed. In one step, a distorted input signal is received that includes an embedded corrupting signal. The embedded corrupting signal is statistically related to the undistorted sound signal. An enhancement signal is determined by finding a difference between the distorted input signal and the enhanced output signal. The enhancement signal attempts to offset the affect of the embedded corrupting signal. Based at least in part upon analyzing the enhancement signal, the enhanced output signal is produced.

32 Claims, 4 Drawing Sheets

OTHER PUBLICATIONS

V. Ramamoorthy, et al., *Enhancement of ADPCM Speech by Adaptive Postfiltering*, AT&T Bell Laboratories Technical Journal, (Oct. 1984), vol. 63, No. 8, pp. 1465-1475.

Juin-Hwey Chen, et al., *Real-Time Vector APC Speech Coding at 4800 BPS with Adaptive Postfiltering*[1], Proc. Int. Conf. Acoust. Speech Sign. Proceedings, (1987), pp. 2185-2188.

Juin-Hwey Chen, et al., *Adaptive Postfiltering for Quality Enhancement of Coded Speech*, IEEE Transactions on Speech and Audio Processing, (Jan. 1995), vol. 3, No. 1, pp. 59-71.

W. Bastiaan Kleijn, *Improved Pitch Prediction*, AT&T Bell Laboratories, pp. 19-20.

R.J. McAulay, et al., *Sinusoidal Coding*, Speech Coding and Synthesis, Elsevier Science B.V., (1995), pp. 121-173.

W. Basitaan Kleijn, et al., *Waveform Interpolation for Coding and Synthesis*, Speech Coding and Synthesis, Elsevier Science B.V., (1995), pp. 175-207.

* cited by examiner

ENHANCED CODED SPEECH

BACKGROUND OF THE INVENTION

This invention relates in general to systems that reduce or remove perceptual distortion in distorted speech signals and, more specifically, to speech signals that have been reconstructed from a coded bit stream and that contain distortion resulting from the encoding-decoding process.

A large number of methods to remove or reduce audible distortion in speech signals currently exist. Methods designed for speech with acoustic background noise (such as car noise or so-called babble noise), generally are based on the assumption of statistical independence of the corrupting signal and the speech signal. As a result, such methods aimed at removing or reducing acoustic background noise (a typical example being described in the paper by Y. Ephraim and H. L. van Trees, "A signal subspace approach for speech enhancement", IEEE Transactions on Speech and Audio Processing, Vol. 3, pp. 251–266, 1995) generally do not perform well on speech-correlated noise. With the reduction of speech-correlated noise, however, the corrupting signal and the speech signal are not statistically independent.

Existing enhancement systems for speech-correlated noise can be motivated using conventional source coding theory for stationary Gaussian processes (signals) with a mean-squared-error distortion criterion, which is well known to persons skilled in the art. (Although the speech signals do not have Gaussian distributions, it is generally held that this theory provides a good approximation for many types of signals.) For example, consider the decoded signal obtained from the encoding at a finite rate, R, of a stationary Gaussian signal. The reconstructed signal corresponding to the minimum mean-squared-error distortion between encoder and decoder can then be shown to have a power spectrum that is not identical to that of the original signal. It is found that the power spectrum of the reconstructed signal equals the power spectrum of the original signal minus the mean squared error. In general, the signal reconstruction has lower energy than the original signal. The decrease in the power spectrum is proportionally strongest in regions of low energy. In other words, the energy of the spectral valleys decreases proportionally more than that of spectral peaks, thus emphasizing the spectral shape.

In speech-coding algorithms, the analysis and synthesis models are generally identical. Thus, the results of source coding theory for Gaussian signals motivate an emphasis of the spectrum of the reconstructed signal by means of a post-filter. In a speech coder, the spectral structure of the signal is generally described by a set of signal-model parameters, and by filtering the output signal of the coder with an appropriate post-filter derived from the parameters, the spectral structure of the reconstructed signal can be emphasized. In general, this emphasis can be performed separately for the spectral fine structure and for the spectral envelope. For good performance, the emphasis of the output speech signal spectrum must be combined with an appropriate adjustment of the encoding. That is, the perceptual weighting that is generally present in the encoder part of state-of-the-art speech coders must be adjusted to account for the post-filter. The combination of a modified encoder and a decoder with added post-filter approximates a coding structure that is optimal for Gaussian signals. State-of-the-art coded-speech enhancement systems can generally be traced back to the work of Ramamoorthy and Jayant (V. Ramamoorthy and N. S. Jayant, "Enhancement of {ADPCM} Speech by Adap-tive Postfiltering", AT&T Bell Labs. Tech. J., 1465–1475, 1984), who introduced an adaptive post-filter structure for the enhancement of coded speech.

The basic method of adaptive post-filtering was improved upon by Chen and Gersho (J.-H. Chen and A. Gersho, "Real-Time Vector APC Speech Coding at 4800 bps with Adaptive Postfiltering", Proc. Int. Conf. Acoust. Speech Sign. Processing, Dallas, 2185–2188, 1987). They introduced the adaptive post-filter structure containing both poles and zeros that is commonly in use today. Typically, this structure is used for the well-known class of linear-prediction based analysis-by-synthesis coders. A good overview of the various flavors of adaptive post-filtering for coded speech enhancement on linear-prediction based (or autoregressive, AR, model based) speech coders was given in a paper by Chen and Gersho in 1995 (J.-H. Chen and A. Gersho, "Adaptive Postfiltering for Quality Enhancement of Coded Speech", IEEE Trans. Speech Audio Process., 3, 1, 59–71, 1995). In the 1995 Chen and Gersho paper, it is shown that, generally, separate post-filters are used to enhance the structure of the spectral fine structure and the spectral envelope. In all these methods, the adaptive post-filter parameter settings are based on the linear predictor of the speech coder. Feedback is used only to ensure that the short-term signal power of the enhanced signal approximates that of the distorted signal.

Particular care must be taken with the post-filter associated with the spectral fine structure. To prevent discontinuities in the short-term correlations whenever the spectral-fine-structure post-filter is adapted, this fine-structure post-filter is generally located prior to the autoregressive (AR) filter used to reconstruct the speech spectral envelope. Since the post-filter associated with the spectral fine structure has an implicit delay, the location of this post-filter results in a mismatch between the time location of the spectral envelope and the spectral fine structure. This problem can be mitigated with a solution described in publications by Kleijn (W. B. Kleijn, "Improved Pitch-period Prediction", Proc. IEEE Workshop on Speech Coding for Telecomm., Sainte-Adele, Quebec, 19–20, 1993 and also in W. B. Kleijn, "Method and Apparatus for Smoothing Pitch-Cycle Waveforms", U.S. Pat. No. 5,267,317, Nov. 30, 1993).

Post-filters have also been used in association with the well-known sinusoidal coders and waveform-interpolation coders. In these coders, the post-filtering is generally associated only with the spectral envelope. This is natural, since these coders have a particular structure that generally results in little perceived distortion being the result of noise signals located in the local spectral valleys. Instead, most of the perceived distortion results from distortion located in the global spectral valleys. Descriptions of these post-filtering methods can be found in R. J. McAulay and T. F. Quatieri, "Sinusoidal Coding", in Speech Coding and Synthesis, W. B. Kleijn and K. K. Paliwal, Eds., Elsevier, Amsterdam, 175–208, 1995, and W. B. Kleijn and J. Haagen, "Waveform interpolation for speech coding and synthesis", in Speech Coding and Synthesis, W. B. Kleijn and K. K. Paliwal, Eds., Elsevier, Amsterdam, 175–208, 1995, respectively.

BRIEF DESCRIPTION OF THE DRAWINGS

The present invention is described in conjunction with the appended figures.

Figure 1:
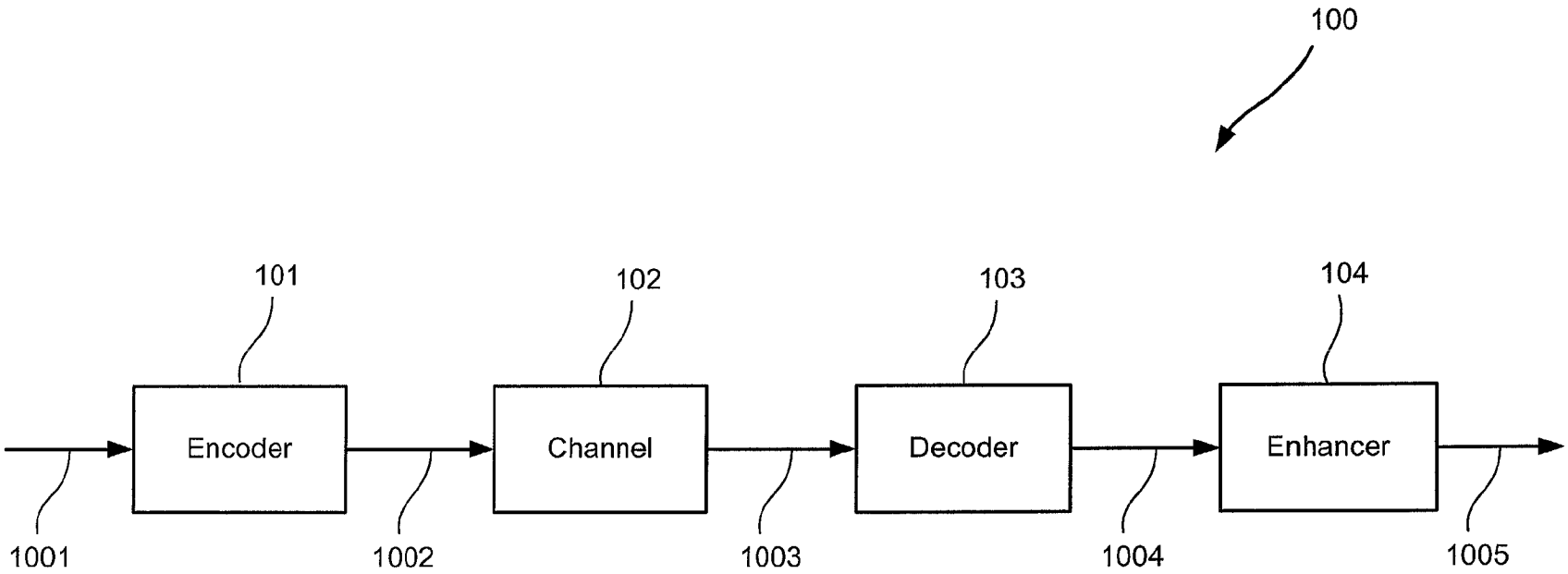
FIG. 1 is a block diagram of an embodiment of an enhancement system.

In the appended figures, similar components and/or features may have the same reference label.

DESCRIPTION OF THE SPECIFIC EMBODIMENTS

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the spirit and scope of the invention as set forth in the appended claims.

The present invention pertains to speech-enhancement systems that have as input a distorted speech signal and as output an enhanced speech signal. Typically, the input to the speech enhancement system is the output of an encoder-decoder system.

Speech signals are often subjected to distortion. Distortion in speech can be the result of, for example, additive environmental noise, nonlinear distortion in an electrical amplification system, and/or an encoding and decoding process. The distortion can be characterized by a difference signal resulting from subtracting the undistorted signal from the distorted signal. Herein, we refer to the difference signal as the corrupting signal.

The purpose of any speech enhancement system is to reduce the subjective (perceptual) and/or objective (as evaluated by a mathematical formula) distortion in speech. An important class of distorted signals is the class of distorted signals that are produced from the output of a speech encoder-decoder system such as those used in voice over Internet protocol (VOIP) systems. Herein, such signals are referred to as coded speech signals or coded speech and serve as the distorted input signal to the speech enhancement system.

The distortion in coded speech signals is generally speech signal dependent. For example, the corrupting signal may have a higher energy in time intervals where the undistorted speech signal has higher energy. Herein, speech-signal-dependent corrupting signals are referred to as speech-correlated noise signals. Although speech-correlated noise signals are better perceptually masked during loud speech signal segments than during quieter speech signal segments, the corrupting signal present during sustained so-called voiced sounds (i.e., sounds with a significant nearly-periodic signal component, where that near-periodicity is produced by a characteristic oscillation of the vocal cords) is often an important contribution or the main contribution to the overall perceived distortion in the reconstructed speech signal.

It is convenient for the present purposes to describe certain speech characteristics through a power spectrum based on the short-term Fourier transform (with window lengths of 20–30 ms for one embodiment). Using methods that are well known to persons skilled in the art, such a power spectrum can be described in terms of the spectral fine structure, which describes the relationship between spectral features nearby in frequency and the spectral envelope, which describes the relation between spectral features that are further apart in frequency. The spectral fine structure is related to local spectral features, whereas the spectral envelope is related to global spectral features. The global spectral features generally carry most of the linguistic information in speech. Local spectral features are what distinguishes regular speech from whispered speech, which is characterized by having no voiced speech. For voiced speech, the spectral fine structure contains harmonically spaced peaks (this harmonic structure corresponds to a nearly periodic time-domain structure).

Due to the particularities of speech encoder-decoder systems, as well as those of the human auditory system, audible distortion in coded voiced speech is typically related to the spectral fine structure. This audible distortion is generally the result of the corrupting signal within the spectral valleys between harmonics, and often more so within the global spectral valleys, i.e., valleys of the spectral envelope. This type of distortion is often perceived similarly to an added white-noise signal.

Reduction of the signal energy within the local spectral valleys (i.e., the valleys located between harmonics) can be an effective method of reducing the audible distortion in coded speech. Alternatively, or in addition, modification of the spectral envelope, so as to emphasize global spectral valleys and global spectral peaks, can be used to reduce the perceived distortion in coded speech.

Conventional adaptive post-filter techniques developed for the enhancement of coded speech signals can be used to obtain reduction of the signal energy within the local spectral valleys for coded speech. Conventional adaptive post-filter techniques can also be used to emphasize the spectral envelope of coded speech. In these conventional techniques, the adaptive post-filter is generally adapted on the basis of parameters that are used in the decoder.

While conventional adaptive post-filter techniques generally reduce the speech-correlated noise signals in sustained vowel sounds, they generally introduce differently perceived distortion that is commonly present in other time intervals. In particular, the conventional adaptive post-filter operations generally strengthen or introduce harmonic structure in some time intervals where this structure is weak or nonexistent. This strengthening or introduction of harmonic structure in inappropriate time intervals leads to an undesirable, so-called, buzzy character of the speech signal. As a result, the application of conventional adaptive post-filter techniques that are aimed at reducing the energy between spectral harmonics, involves a trade-off between noise-like and buzzy artifacts in the reconstructed speech signal.

Thus, upon strengthening the periodic character of the speech, a noise-like and/or buzzy character remains. The remaining perceived distortion can be reduced further through modification of the spectral envelope so as to reduce the energy of the global spectral valleys that likely contain local spectral valleys that cause audible distortion. This action generally results in a less natural speech sound resulting from the distortion of the spectral envelope. This enhancement involves a trade-off between a noise-like or buzzy character of the reconstructed speech signal and the decrease in naturalness due to distortion of the spectral envelope.

For another perspective on the problems associated with conventional post-filtering techniques, it is useful to define an enhancement signal that is the subtraction of the distorted input signal from the enhanced output signal. In conventional enhancement systems, the relative power of the enhancement signal will vary strongly as a function of time. In certain time intervals the enhancement signal may have (too) much energy, and in others it may have (too) little. The enhancement operation settings usually form a heuristic compromise between such time regions. This is a result from the enhancement system operation being based on the input signal only, other than the signal power conservation that is used in many systems. In this sense, the operation of the enhancement system can be said to be open-loop. Other than the energy normalization, no feedback exists to ensure the enhancement system achieves its objectives.

In addition to a first constraint that makes sure the short-term signal power is retained upon enhancement, we introduce a second constraint to the speech-enhancement unit. The second constraint is that the enhancement signal (defined as a difference signal resulting from subtracting the distorted signal from the enhanced signal) is constrained to have a power that is less than or equal to a certain fraction of the power of the distorted speech signal. The second constraint prevents the common artifacts resulting from "over-enhancement" during some time intervals. Yet, for certain enhancement units, the second constraint does not noticeably affect the effectiveness of the enhancement in sustained voiced regions environments, where enhancement of speech signals corrupted by speech-correlated noise is typically most needed.

In one embodiment, the second constraint is applied to an enhancement procedure that increases the periodicity of the speech signal. Our embodiment of a speech enhancement unit increases the periodicity of speech and includes the second constraint. The speech enhancement unit includes two basic steps, each performed for each time sample of the signal. The first part of the first step includes defining a pitch period as a function of time around the time sample based on a correlation measure. The second part of the first step includes sampling the distorted input signal using sampling intervals of precisely one pitch period, to obtain a pitch-period-synchronous sequence. We create such a pitch-period-synchronous sequence for each sample of the distorted input signal (the sample of the distorted speech signal is also a sample of the corresponding pitch-period-synchronous sequence). In our embodiment, the pitch-period-synchronous sequences are limited to a finite length. In one embodiment, the pitch-period-synchronous sequence is selected to have a length of five samples.

To simplify processing in this embodiment, the pitch-period-synchronous sequence is determined simultaneously for a set of consecutive samples of the distorted input signal. We refer to such a set of consecutive samples as a sample-sequence. Our simultaneous determination of pitch-period-synchronous sequences results in a pitch-period-synchronous sequence of sample-sequences. The sample-sequences for one embodiment are chosen to have a length of 5 ms.

The second step of our enhancement operator includes re-estimating each sample based on the corresponding pitch-period-synchronous sequence, the first signal-power constraint and the second constraint operating on the enhancement signal. The sequence of re-estimated samples forms the enhanced speech signal. The enhanced speech signal is more periodic than the distorted speech signal, when the signal is voiced (and the pitch-period-synchronous sequence corresponds to a nearly periodic sampling of the distorted signal). To simplify the processing, the re-estimation is also performed simultaneously for a sample-sequence, rather than for each sample individually for this embodiment.

It is noted that in regions where the speech signal is not nearly periodic, the speech enhancement system does not change the distorted signal significantly. However, whenever the distorted speech signal is nearly periodic, the speech enhancement system effectively removes or reduces the audible distortion. It is also noted that the second constraint not only results in a reduction of artifacts, but that it also results in an insensitivity to lack of robustness of determination of pitch-period-synchronous sequences.

Referring first to FIG. 1, an embodiment of an enhancement system 100 is shown in block diagram form that demonstrates a speech-enhancement method for processing a distorted speech input signal corrupted by speech-correlated noise. The distorted input signal is the output of a speech encoding-decoding system, such as those used for VOIP communication. An undistorted speech signal 1001 is encoded by encoder 101 to render a first bit stream 1002. The first bit stream 1002 is conveyed through a channel 102, which can be a communication network or a storage device. For example, the channel 102 could be the Internet. The channel 102 renders a second bit stream 1003, which can be identical to the first bit stream 1002 or could be missing packets or otherwise modified. The decoder 103 takes the second bit stream 1003 as an input and renders a reconstructed speech signal 1004 as an output. During the encode process, transport through the channel 102 and the decode process a corrupting signal may be introduced. This corrupting signal is equal to the difference between the reconstructed speech signal 1004 and the undistorted speech signal 1001. The reconstructed speech signal 1004 or distorted speech signal is the input for the enhancer 104, which produces an enhanced speech signal 1005 as an output. In comparison to the reconstructed speech signal 1004, the enhanced speech signal 1005 more closely approximates the undistorted speech signal 1001 according to perceptually-based measures.

Figure 2:
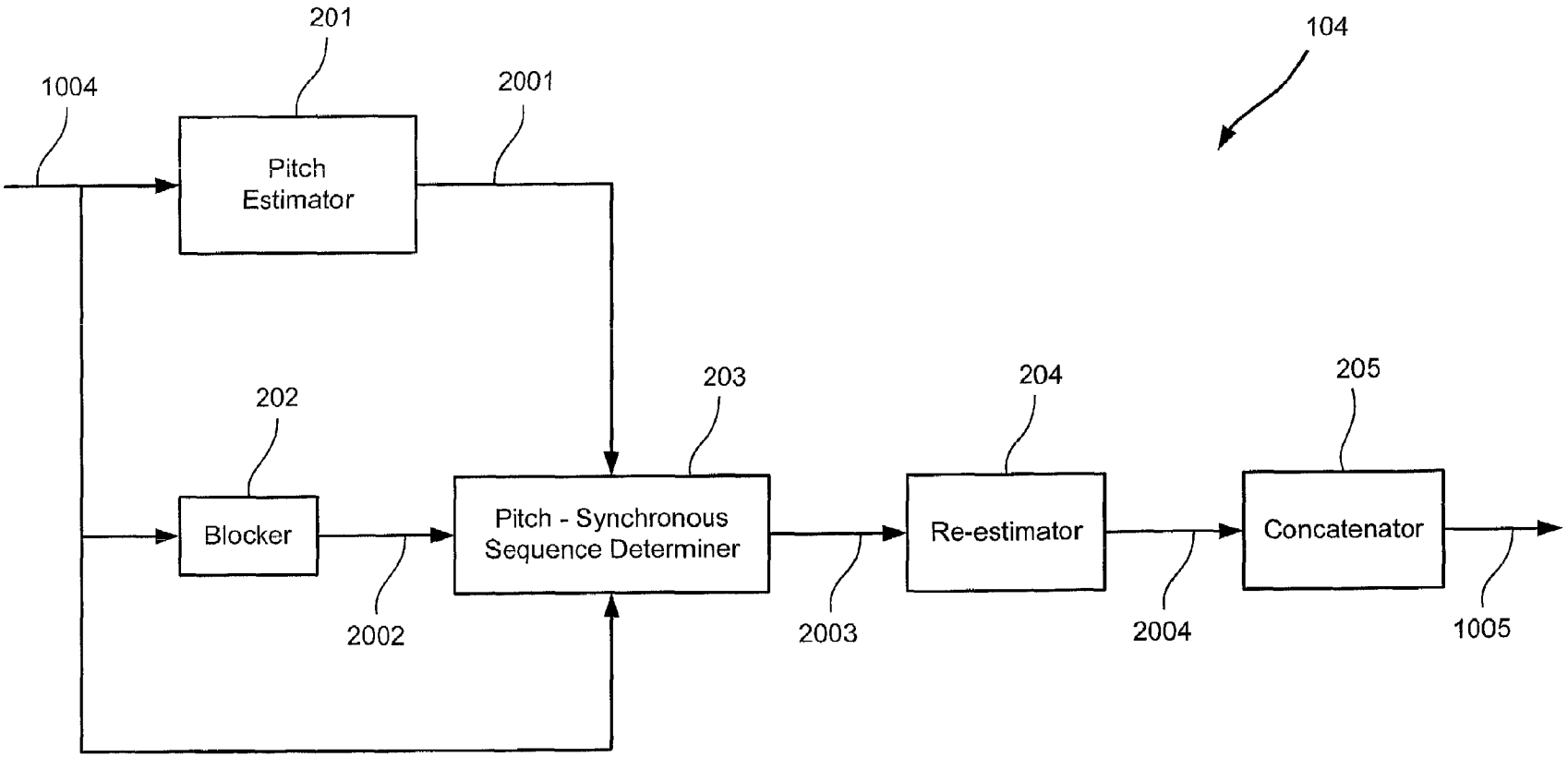
FIG. 2 is a block diagram of an embodiment of an enhancer.

With reference to FIG. 2, a block diagram of an embodiment of the enhancer 104 is shown. This embodiment 104 performs pitch-period track estimation, determination of pitch-period-synchronous sequence of sample-sequences, and constrained re-estimation of the speech signal. The reconstructed or distorted speech signal 1004 forms the input for the pitch-period estimator 201 and a pitch-period period track 2001 forms the output. A blocker 202 selects each subsequent block of L samples of the distorted speech signal 1004 to render as an output the current sample-sequence 2002 having L samples. The pitch-period-synchronous-sequence determiner 203 produces a sequence of N sample-sequences 2003 where each of the N sample-sequence has L samples. The sequence of N sample-sequences 2003 is based on the current sample sequence 2002, pitch-period period track 2001 and the distorted input signal 1004.

The sequence of N sample-sequences 2003 are synchronous with the pitch-period. The pitch-period-synchronous sequence of sample-sequences 2003 forms the input to re-estimator 204. Re-estimator 204 provides a re-estimated sample-sequence of L samples for every current sample-sequence 2002 that is produced by the blocker 202. A concatenator 205 concatenates the re-estimated sample-sequences 2004 into the enhanced signal 1005. The individual steps of some of the above blocks are described in more detail in the following paragraphs.

The first step described for the present embodiment of the enhancer 104 is the estimation of the pitch-period period at regular intervals (i.e., estimation of a pitch-period period track 2001). For this purpose any state-of-the-art pitch-period period estimator can be used. We describe a particular pitch-period period estimator embodiment that performs satisfactorily for this embodiment. The sequence of pitch-period period estimates forms a so-called pitch-period period track 2001.

To obtain the pitch-period period estimate, we first determine the normalized correlations, $r_i(n)$:

$$r_i(n) = \frac{\sum_{m=1}^{m=M} s(Mi+m)s(Mi+m-n)}{\sqrt{\sum_{m=1}^{m=M} s^2(Mi+m-n)}},$$

where s(Mi+m) is the distorted speech signal 1004 with sample index Mi+m, i is an integer block index, n is the integer candidate pitch-period period, m is an integer sample index, and where M is an integer block length, which is selected to be about 50 samples at a sampling rate of 8000 Hz for one embodiment. For the same sampling rate, the values of n are selected to be within the set of candidate pitch-period periods G, which contains the integers from 20 to 147 for one embodiment. We note that the normalization is only with respect to the sliding window (the segment that moves with n) and not with respect to the stationary part.

Smoothed correlations, $sr_i(n)$, are created by zero-phase low-pass filtering (using a seven-tap Hann window in one embodiment) the autocorrelation sequences $r_i(n)$. An overall correlation function, $R_i(n)$, corresponding to the pitch-period period at block i (containing samples {Mi+1, . . . , M(i+1)}) is obtained by a weighted addition of smoothed and un-smoothed correlation functions. In one embodiment, the weighted addition can be done according to the following empirical weighting:

$$R_i(n)=0.5sr_{i-2}(n)+0.8sr_{i-1}(n)+r_i(n)+0.8sr_{i+1}(n)+0.5sr_{i+2}(n).$$

Other weightings, that include additional correlation functions, can also be used.

The pitch-period period corresponding to segment i is the value $n_{opt}$ for the candidate pitch-period period n that maximizes $R_i$ (n):

$$n_{opt} = \arg\max_{n \in G} R_i(n),$$

where G is the set of candidate pitch-period periods.

A second step described for the present embodiment of the enhancer 104 is the determination of a pitch-period-synchronous sequence of sample-sequences 2003. In the present embodiment, the pitch-period-synchronous sequence of sample-sequences 2003 includes N sample-sequences, each sample-sequence having L samples. A pitch-period-synchronous sequence of sample-sequences 2003 is determined for each consecutive block of L samples. L is set to 40 samples for an 8000 Hz sampling rate and N is set to 5 in one embodiment. The pitch-period-synchronous sequence of sample-sequences 2003 is determined recursively, both forward- and backward-in-time.

Figure 3:
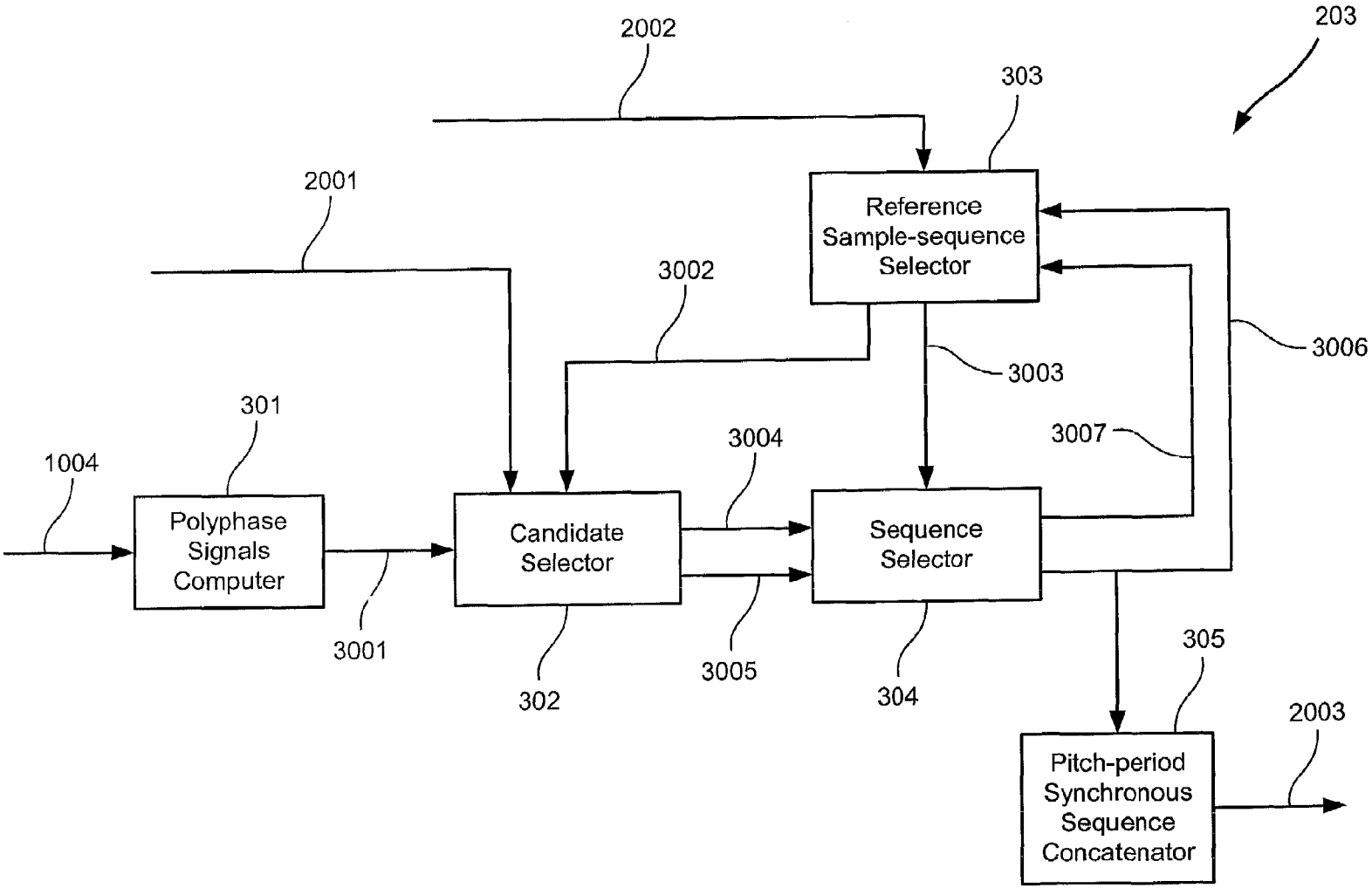
FIG. 3 is a block diagram of an embodiment of a pitch-period-synchronous sample-sequence determiner.

Referring next to FIG. 3, a block diagram of an embodiment of a pitch-synchronous-sequence determiner 203 is shown in block diagram form. This figure provides an overview of the determination of the pitch-period-synchronous sequence of sample-sequences 2003. The distorted speech signal 1004 first enters the poly-phase signals computer 301. A set of Q poly-phase signals 3001 forms the output of the poly-phase signals computer 301.

For each current sample sequence 2002, a recursive pitch-period-synchronous sequence determination is performed by the sequence determiner 203. Within the pitch-synchronous sequence determiner 203, the reference sample-sequence selector 303 chooses a current reference sample-sequence 3003. For both the first iteration backward- and forward-in-time, this current reference sample-sequence 3003 is the current sample-sequence 2002 that is the output from blocker 202. For further iterations, the previously-selected sample-sequence 2002 becomes the next reference sample sequence 3003. The reference selector 303 also keeps track of the delay of the last selected sample-sequence 2002 and provides the accumulated delay 3002 to candidate selector 302.

The candidate-selector 302 has the poly-phase signals 3001 as inputs. It selects and outputs a plurality of candidate sample-sequences 3004 that are candidates for being the next sample-sequence 3006. The candidate-selector 302 also has as an output the corresponding delays relative to the current reference sample-sequence 3003. The sequence selector 304 chooses from the candidate sample-sequences 3004 the sample-sequence 3006 that is most similar to the reference sample-sequence 3003 and provides this sample-sequence 3006 to both a pitch-period-synchronous sequence concatenator 305 and to a reference sample-sequence selector 303. The sequence selector 304 also provides a delay 3007 of the selected sample-sequence 3006 with respect to the current reference sample sequence 300 to the reference sample-sequence selector 303.

The pitch-period-synchronous sequence concatenator 305 provides a pitch-period-synchronous sequence of sample-sequences 2003 as output. That output 2003 is fed to the re-estimator 204.

Next, we describe the procedure followed by the pitch-synchronous-sequence determiner 203 with some more detail for a backward iterative procedure. The forward iterative procedure is analogous and can be appreciated by one skilled in the art reading this specification. Some embodiments could use backward iterations, forward iterations or a hybrid approach using both. We note that this embodiment determines the sequence of sample-sequences in a computationally efficient, recursive manner.

The current reference sample-sequence 3003 is initially defined as the current block of L samples in the reference sample-sequence selector 303. Each subsequent reference sample-sequence 3003 is found recursively in the following steps. In a first step, a poly-phase signal computer 301 first up-samples a signal segment 1004 that includes the current sample-sequence 3003 by a factor, Q, where Q is set to 8 for a sampling rate of 8000 Hz in one embodiment. The up-sampling is done with a windowed sinc function in this embodiment. The poly-phase signal computer 301 then determines Q poly-phase sample-sequences 3001 corresponding to that region including the current block. Each of the Q poly-phase sample-sequences 3001 has the same sampling rate as the original signal 1004, but is offset by a fractional sampling interval. In the next step, the candidate selector 302 determines a plurality of sample-sequences of L samples 3004 at the original sampling rate from the poly-phase sample-sequences 3001 that are offset by $$-P-\frac{K}{Q}, \ldots, -P-\frac{2}{Q}, -P-\frac{1}{Q}, -P, -P+\frac{1}{Q}, -P+\frac{2}{Q}, \ldots, -P+\frac{K}{Q}$$

samples from the current sample-sequence 3003, where $$\frac{K}{Q}$$

is set to the value two for a sampling rate of 8000 Hz in one embodiment. These resulting sample-sequences are called the candidate sample-sequences 3004. In a third step, the sequence selector 304 determines from the plurality of poly-phase sample-sequences 3004 the sample-sequence 3006 that has the highest correlation coefficient with the reference sample-sequence 3003. It determines the delay $$P-\frac{k}{Q}$$

(where k is an integer in the range −K, . . . ,K) 3007 of this sequence 303 sets the reference sample-sequence 3003 to be the newly selected sample-sequence 3006. In further steps, the procedure is repeated until the required number of sample-sequences backward-in-time is found.

The forward-in-time part of the pitch-period-synchronous sequence process is determined in a manner analogous to the backward-in-time part of the pitch-period-synchronous sequence. To reduce the delay of the enhancement operator 104, the number of sample-sequences forward-in-time can be reduced and the number of sample-sequences backward-in-time can be increased in various embodiments.

For each sample-sequence 2002, i.e., for each current sample-sequence, the constrained re-estimation operation performed by the re-estimator 204 provides a current sample-sequence output 2004 based on the current pitch-period-synchronous sequence of N sample-sequences 2003. With $x_m$ being the sample-sequence with an index m in the pitch-period-synchronous sequence of sample-sequences 2003 defined for the current sample-sequence. Furthermore, $x_0$ is the current sample-sequence (the current block of L samples) 2002. We then define the following cross-correlation based periodicity criterion that defines a measure of periodicity for the pitch-period-synchronous sequence $$\eta = \sum_{m=-W,\ldots,W,m\neq 0} \alpha_m \tilde{x}_0^T x_m,$$

where $\tilde{x}_0$ is a modified current sample-sequence, the integer W=(N−1)/2 (for the case that N is an odd integer), and $\alpha_m$ defines a weighting window that specifies the weightings of the respective inner product between this modified current sample-sequence and the sample-sequences $x_m$. For this embodiment, the weighting is set based on perceptual criteria. In the present embodiment, a modified Hanning weighting is used for the coefficients $\alpha_m$:

$$\alpha_m = \frac{1}{2}\left(1-\cos\left(\frac{2\pi(m+W)}{N-1}\right)\right),\ m-W,\ \ldots,\ -1,\ 1,\ \ldots\ W,$$

where $\alpha_m$ is defined only for the given values of m. A similarly modified Hamming or other smooth weighting performs similarly.

One objective of the re-estimation procedure 204 is to find the modified current sample-sequence $\tilde{x}_0$ 2004 that maximizes the periodicity criterion under two constraints. The first constraint is straightforward and known to persons skilled in the art: it specifies that the modified vector have the same energy as the original vector:

$$\tilde{x}_0^T\tilde{x}_0=(x_0+d)^T(x_0+d)=x_0^Tx_0,$$

where we introduced the difference vector $d=\tilde{x}_0-x_0$.

The second constraint is that the difference vector $d=\tilde{x}_0-x_0$, i.e., the modification, should have relative low energy:

$$d^Td\leqq\beta x_0^Tx_0,$$

where β is a constant such that $0\leqq\beta<<1$. In one embodiment, the value selected for β is in the range between 0.03 and 0.3, with a larger value resulting generally in stronger enhancement of the signal periodicity. Those skilled in the art appreciate that clearly non-periodic signals cannot generally be converted into nearly periodic signals. The purpose of the second constraint is to prevent production of an enhanced signal 1005 is significantly different from the original signal 1004. From another viewpoint, the second constraint limits the numerical size of the errors that the enhancement procedure can make.

In the context of the second constraint, an additional, previously unknown, purpose of the first constraint can be appreciated. This purpose is not relevant in the conventional application of the first constraint to conventional post-filtering procedures. The additional purpose of the first constraint is to make sure that non-periodic signal components are removed when periodic signal components are present. This effect of the first constraint in the context of the second constraint is particularly well illustrated in the frequency domain. In the frequency domain, the second constraint leads to a simultaneous reduction of energy in the local valleys and increase in energy of the local peaks.

To achieve constrained optimization Lagrange multipliers are used. The extended periodicity optimization criterion (the Lagrangian) is $$\eta = \sum_{m=-M,\ldots,M,m\neq 0} (\alpha_m(x_0+d))^T x_m + (\lambda_1(x_0+d))^T(x_0+d) + \lambda_2 d^T d,$$

where omitted terms are not dependent on d and where $\lambda_2=0$ if the second constraint is satisfied. Let us first consider the case where $\lambda_2\neq 0$, for example. The first step towards obtaining the solution of the constrained optimization problem is to differentiate towards d and set the resulting expression equal to zero, $$0=\frac{\partial\eta}{\partial\tilde{x}_0}=\sum_{m=-M,\ldots,M,m\neq 0}\alpha_m x_m + 2\lambda_1(x_0+d) - 2\lambda_2 d.$$

Let us now define:

$$y=\sum_{m=-W,\ldots,W,m\neq 0}\alpha_m x_m.$$

We can then express the difference vector, d, as $$d = \frac{y + 2\lambda_1 x_0}{2\lambda_1 + 2\lambda_2} = Ay + Bx_0,$$

where we defined two convenient constants, A and B. Through some algebra, it is found that, to satisfy the constraints, we have $$A = \left( \frac{\left(\beta - \frac{\beta^2}{4}\right) x_0^T x_0}{y^T y - \frac{(y^T x_0)^2}{x_0^T x_0}} \right)^{1/2} \text{ and}$$

$$B = -\frac{\beta}{2} - A\frac{y^T x_0}{x_0^T x_0}.$$

This solution for the constrained optimization problem is valid for the case where the second constraint, which is an inequality constraint, can be considered to be an equality constraint. In this case, we can obtain the optimally modified current sample-sequence by first computing A and B and then computing $\tilde{x}=Ay+(B+1)x_0$ for this embodiment.

Next, we consider the case where the inequality constraint is a true inequality, and only the first constraint is considered in the optimization. In this case the extended periodicity criterion is:

$$\eta = \sum_{m=-M,\ldots,M,\, m\neq 0} (\alpha_m(x_0 + d))^T x_m + (\lambda_1(x_0 + d))^T (x_0 + d).$$

The difference vector can then be written as:

$$d = -\frac{y + 2\lambda_2 x_0}{2\lambda_2} = Cy - x_0.$$

It is found that:

$$C = \sqrt{\frac{x_0^T x_0}{y^T y}}$$

and that :

$$\tilde{x}_0 = \sqrt{\frac{x_0^T x_0}{y^T y}}\, y.$$

In other words, in the case where the inequality constraint (the second constraint) is not activated, $\tilde{x}_0$ is simply y, scaled to the correct energy in this embodiment.

Figure 4:
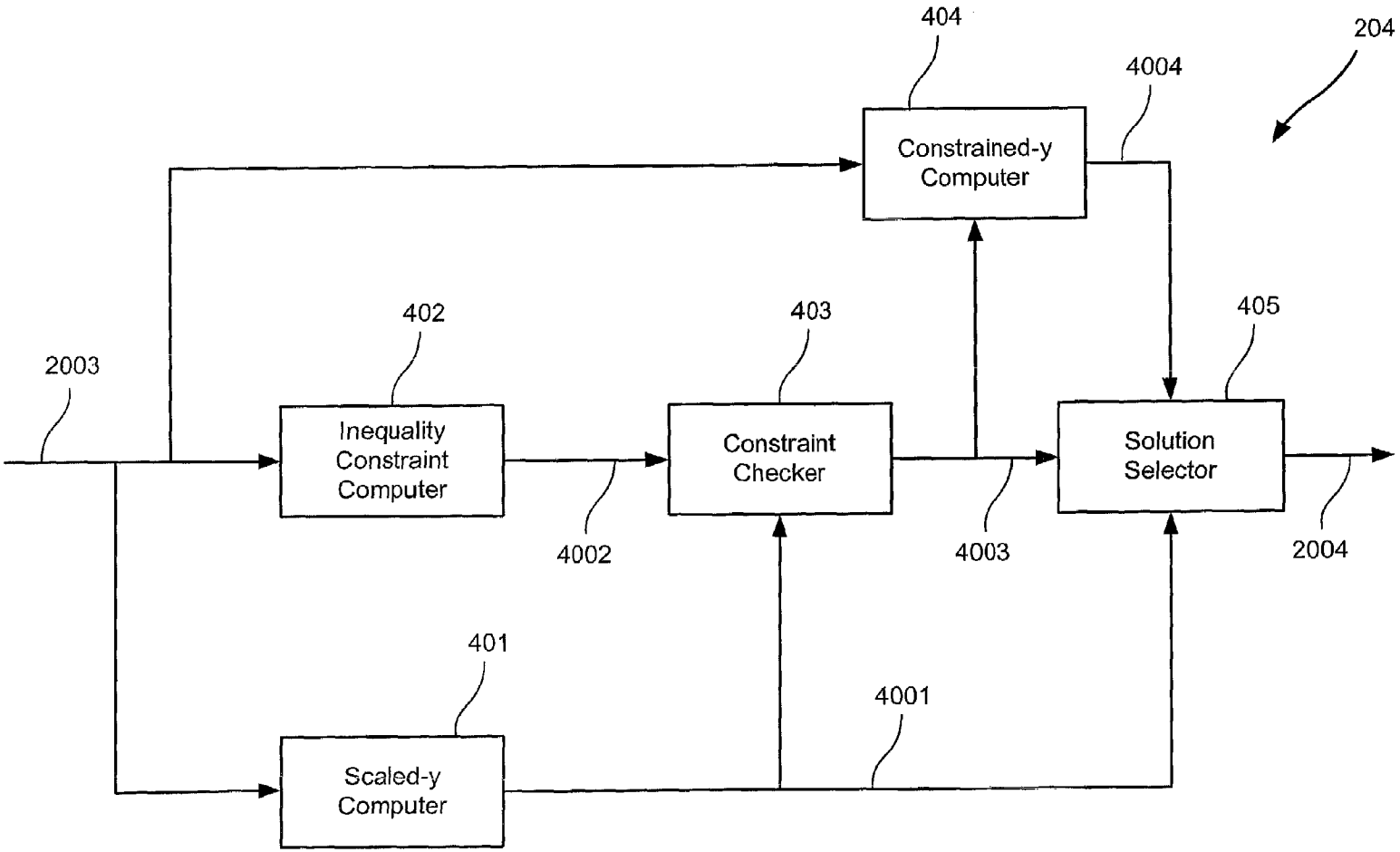
FIG. 4 is a block diagram of an embodiment of a re-estimation operation, which is based on the pitch-period-synchronous sequence of sample-sequences.

Referring next to FIG. 4, an embodiment of a re-estimator 204 is shown that illustrates a procedure for the determination of the re-estimated current sample-sequence 2004. Based on the pitch-period-synchronous sequence of sample-sequences 2003, scaled-y-computer 401 computes the scaled-y estimate 4001, which is $$\tilde{x}_0 = \sqrt{\frac{x_0^T x_0}{y^T y}}\, y.$$

Based on the same pitch-period-sequence of sample-sequences input 2003, the inequality constraint computer 402 computes a value 4002, which represents $\beta x_0^T x_0$. The constraint checker 403 compares the scaled-y estimate 4001 and the value 4002 to decide whether the scaled-y estimate 4001 satisfies the inequality constraint. The constraint checker 403 communicates its decision through a decision value 4003. The constrained-y computer 404 computes the constrained solution vector 4004 of $\tilde{x}_0=Ay+(B+1)x_0$. The constrained-y computer only does this computation when the decision value 4003 indicates that the computation is needed. The constrained solution vector 4004 is provided to a solution selector 405 when this computation is needed. The solution selector 405 provides the sample-sequence that corresponds to the re-estimated sequence of sample-sequences 2004.

In summary, the entire re-estimation procedure 204 is performed with two simple steps in this embodiment. In the first, we check if $$\tilde{x}_0 = \sqrt{\frac{x_0^T x_0}{y^T y}}\, y$$

satisfies the inequality constraint $d^T d \leqq \beta x_0^T x_0$. If it does, this solution for $\tilde{x}_0$ is used. In the next step, we compute A and B and use the $\tilde{x}_0=Ay+(B+1)x_0$ solution if the previous solution does not satisfy the inequality constraint.

A number of variations and modifications of the invention can also be used. For example, any coded sound signal could be processed by the above system and not just coded speech signals. Further, any combination of software and/or hardware distributed among one or more computer systems could be used to implement the above concepts as is well known in the art. Even though the above description primarily relates to reduction of speech-correlated noise, some embodiments could additionally provide background noise reduction techniques.

While the principles of the invention have been described above in connection with specific apparatuses and methods, it is to be clearly understood that this description is made only by way of example and not as limitation on the scope of the invention.

What is claimed is:

1. A method for increasing quality of an enhanced output signal to approximate an undistorted sound signal, the method comprising steps of:

receiving a distorted input signal that includes an embedded corrupting signal, wherein the embedded corrupting signal is statistically related to the undistorted sound signal;

defining an enhancement signal as the difference between the distorted input signal and the enhanced output signal, whereby the enhancement signal attempts to offset the embedded corrupting signal;

determining a power of the enhancement signal;

constraining possible values for the power of the enhancement signal based on characteristics of the distorted input signal; and producing the enhanced output signal, based at least in part upon constrained values of the power of the enhancement signal resulting from the constraining step.

2. The method for increasing quality of the enhanced output signal to approximate the undistorted sound signal as recited in claim 1, wherein the power of the enhancement signal is determined over a finite-support window.

3. The method for increasing quality of the enhanced output signal to approximate the undistorted sound signal as recited in claim 2, further comprising a step of increasing the periodicity of the distorted input signal.

4. The method for increasing quality of the enhanced output signal to approximate the undistorted sound signal as recited in claim 1, further comprising a step of increasing the periodicity of the distorted input signal.

5. The method for increasing quality of the enhanced output signal to approximate the undistorted sound signal as recited in claim 1, further comprising a step of feeding-back the enhanced output signal to affect determination of the enhanced output signal.

6. The method for increasing quality of the enhanced output signal to approximate the undistorted sound signal as recited in claim 1, further comprising additional defining, determining, constraining and producing steps to iteratively refine the enhanced output signal.

7. The method for increasing quality of the enhanced output signal to approximate the undistorted sound signal as recited in claim 1, further comprising a step of determining an amount of forward-in-time sample-sequences to use in determining the enhanced output signal.

8. The method for increasing quality of the enhanced output signal to approximate the undistorted sound signal as recited in claim 1, further comprising a step of determining an amount of backward-in-time sample-sequences to use in determining the enhanced output signal.

9. The method for increasing quality of the enhanced output signal to approximate the undistorted sound signal as recited in claim 1, wherein the embedded corrupting signal is introduced as an artifact of encoding and decoding of the undistorted sound signal.

10. A computer-readable medium having computer-executable instructions for performing the computer-implementable method for increasing quality of the enhanced output signal to approximate the undistorted sound signal of claim 1.

11. The method for increasing quality of the enhanced output signal to approximate the undistorted sound signal as recited in claim 1, wherein the undistorted sound signal is an undistorted speech signal and the distorted input signal is a distorted input speech signal.

12. The method for increasing quality of the enhanced output signal to approximate the undistorted sound signal as recited in claim 1, wherein the constraining step includes constraining possible values for the power of the enhancement signal such that the power is less than or equal to a certain fraction of a power of the distorted input signal.

13. The method for increasing quality of the enhanced output signal to approximate the undistorted sound signal as recited in claim 12, wherein the undistorted sound signal is an undistorted speech signal and the distorted input signal is a distorted input speech signal.

14. A method for increasing quality of an enhanced output signal to approximate an undistorted sound signal, the method comprising steps of:

receiving a distorted input signal that includes an embedded corrupting signal, wherein the embedded corrupting signal is statistically related to the undistorted sound signal;

estimating a first iteration enhanced output signal;

defining a first iteration enhancement signal as the difference between the distorted input signal and the first iteration enhanced output signal;

determining a power of the first iteration enhancement signal;

constraining possible values for the power of the first iteration enhancement signal based on characteristics of the distorted input signal; and producing a second iteration enhanced output signal, based at least in part upon constrained values of the power of the first iteration enhancement signal resulting from the constraining step.

15. The method for increasing quality of the enhanced output signal to approximate the undistorted sound signal as recited in claim 14, wherein the power of the enhancement signal is determined over a finite-support window.

16. The method for increasing quality of the enhanced output signal to approximate the undistorted sound signal as recited in claim 15, further comprising a step of increasing periodicity of the distorted input signal.

17. The method for increasing quality of the enhanced output signal to approximate the undistorted sound signal as recited in claim 14, further comprising a step of increasing periodicity of the distorted input signal.

18. The method for increasing quality of the enhanced output signal to approximate the undistorted sound signal as recited in claim 14, further comprising a step of determining an amount of forward-in-time sample-sequences to use in determining the enhanced output signal.

19. The method for increasing quality of the enhanced output signal to approximate the undistorted sound signal as recited in claim 14, further comprising a step of determining an amount of backward-in-time sample-sequences to use in determining the enhanced output signal.

20. The method for increasing quality of the enhanced output signal to approximate the undistorted sound signal as recited in claim 14, wherein the embedded corrupting signal is introduced as an artifact of encoding and decoding of the undistorted sound signal.

21. The method for increasing quality of the enhanced output signal to approximate the undistorted sound signal as recited in claim 14, wherein the first iteration enhancement signal and the second iteration enhancement signal correspond to a same portion of the undistorted sound signal.

22. A computer-readable medium having computer-executable instructions for performing the computer-implementable method for increasing quality of the enhanced output signal to approximate the undistorted sound signal of claim 14.

23. The method for increasing quality of the enhanced output signal to approximate the undistorted sound signal as recited in claim 14, wherein the undistorted sound signal is an undistorted speech signal and the distorted input signal is a distorted input speech signal.

24. The method for increasing quality of the enhanced output signal to approximate the undistorted sound signal as recited in claim 14, wherein the constraining step includes constraining possible values for the power of the first iteration enhancement signal such that the power is lessthan or equal to a certain fraction of a power of the distorted input signal.

25. The method for increasing quality of the enhanced output signal to approximate the undistorted sound signal as recited in claim 24, wherein the undistorted sound signal is an undistorted speech signal and the distorted input signal is a distorted input speech signal.

26. A sound enhancement system that improves a distorted input signal to produce an enhanced output signal where the distorted input signal includes an embedded corrupting signal, wherein the embedded corrupting signal is statistically related to an undistorted sound signal, the sound enhancement system comprising:

an enhancement circuit that receives the distorted input signal and produces a first iteration enhanced output signal, wherein the enhancement circuit:

defines the first iteration enhancement signal as the difference between the first iteration enhanced output signal and the distorted input signal;

determines a power of the first iteration enhancement signal; and constrains possible values for the power of the first iteration enhancement signal based on characteristics of the distorted input signal;

a feedback circuit that feeds back the first iteration enhancement signal as an improved distorted input signal to effect production of a second iteration enhanced output signal by the enhancement circuit; and an output circuit that produces the enhanced output signal upon completion of at least one iteration cycle.

27. The sound enhancement system as recited in claim 26, wherein the power of the first iteration enhancement signal is determined over a finite-support window.

28. The sound enhancement system as recited in claim 26, wherein the periodicity of the distorted input signal is increased by the enhancement circuit.

29. The sound enhancement system as recited in claim 26, wherein the embedded corrupting signal is introduced as an artifact of encoding and decoding of the undistorted sound signal.

30. The sound enhancement system as recited in claim 24, wherein the undistorted sound signal is an undistorted speech signal and the distorted input signal is a distorted input speech signal.

31. The sound enhancement system as recited in claim 26, wherein the enhancement circuit constrains possible values for the power of the first iteration enhancement signal such that the power is less than or equal to a certain fraction of a power of the distorted input signal.

32. The sound enhancement system as recited in claim 31, wherein the undistorted sound signal is an undistorted speech signal and the distorted input signal is a distorted input speech signal.

* * * * *